US009518354B2

(12) United States Patent
Kulkarni et al.

(10) Patent No.: US 9,518,354 B2
(45) Date of Patent: Dec. 13, 2016

(54) CLOTHES DRYER WITH IMPROVED MOISTURE SENSING AND WIRELESS DATA TRANSFER

(71) Applicant: General Electric Company, Schenectady, NY (US)

(72) Inventors: Ashutosh Kulkarni, Bangalore (IN); Jaeseok Noh, Seongnam-si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 406 days.

(21) Appl. No.: 14/307,861

(22) Filed: Jun. 18, 2014

(65) Prior Publication Data

US 2015/0368853 A1 Dec. 24, 2015

(51) Int. Cl.
*D06F 58/28* (2006.01)
*D06F 58/04* (2006.01)

(52) U.S. Cl.
CPC ..... *D06F 58/28* (2013.01); *D06F 58/04* (2013.01); *D06F 2058/2838* (2013.01); *D06F 2058/2861* (2013.01)

(58) Field of Classification Search
CPC .. D06F 58/28; D06F 58/04; D06F 2058/2861; D06F 2058/2838
See application file for complete search history.

(56) References Cited

U.S. PATENT DOCUMENTS

| | | | | |
|---|---|---|---|---|
| 3,203,107 | A | 8/1965 | Scofield | |
| 2011/0203131 | A1 | 8/2011 | Armstrong | |
| 2016/0053427 | A1* | 2/2016 | Noh | D06F 58/28 34/427 |
| 2016/0201253 | A1* | 7/2016 | Kulkarni | D06F 58/28 307/104 |

FOREIGN PATENT DOCUMENTS

| | | |
|---|---|---|
| EP | 1 148 169 | 10/2001 |
| EP | 1 321 563 | 6/2003 |
| EP | 1 997 951 | 3/2011 |
| EP | 2 527 517 | 11/2012 |
| WO | WO 2004/022836 | 3/2004 |
| WO | WO 2013/182402 | 12/2013 |

* cited by examiner

*Primary Examiner* — Jiping Lu
(74) *Attorney, Agent, or Firm* — Dority & Manning, P.A.

(57) ABSTRACT

A clothes dryer with improved moisture sensing and wireless data transfer is provided. An example drying appliance includes a plurality of sensors positioned inside a drum of the drying appliance. The plurality of sensors are wired together to provide a combined output signal indicative of one or more parameters of clothing inside the drum. The drying appliance includes a near field communication (NFC) tag mounted on an exterior surface of the drum. The NFC tag receives the combined output signal from the plurality of sensors. The drying appliance includes an NFC reader positioned on a stationary member of the drying appliance and receiving external utility power. The NFC reader receives sensor data from the NFC tag and provides the sensor data to a controller, such that the controller can control the drying appliance based on the one or more parameters of the clothing inside the drum.

20 Claims, 8 Drawing Sheets

CLOTHES DRYER WITH IMPROVED MOISTURE SENSING AND WIRELESS DATA TRANSFER

FIELD OF THE INVENTION

The present disclosure relates generally to a clothes dryer with improved moisture sensing and wireless data transfer. More particularly, the present disclosure relates to a clothes drying appliance with improved sensor positioning enabled by a near field communication system including components such as tag, reader, filtering, and processing components and suitable data converters and amplifiers.

BACKGROUND OF THE INVENTION

In order to provide enhanced control of a clothes drying appliance, it can be desirable to know the moisture content of clothing being dried by a clothes dryer. For example, the dryer can be operated until it is sensed that the moisture content of the clothing has fallen below a desired amount. The heater or other appropriate components of the clothes dryer can then be de-energized or otherwise controlled accordingly.

Certain existing clothes dryers use two metal rods in parallel or a combination of rods and the drum surface as a sensor to detect available moisture in the clothing. Other sensors for detecting temperature and relative humidity can be added as well to sense internal air properties.

These sensors typically receive excitation power from the dryer control board via a physical connection such as electrical wires. Therefore, the sensors are placed on a non-rotating components of the dryer, such as the door or a fixed back wall. In some applications the sensors are mounted on a rotating surface and connected to controller using devices such as slip rings.

However, for many of such sensors, physical contact between the sensor and the clothes being dried is required for accurate sensor readings. Therefore, sensors positioned on the non-rotating components of the dryer, such as the door or a fixed back wall can have less frequency of contact with the entire clothing and do not provide consistently accurate readings.

In other words, because the clothing being dried is much less probable to contact the non-rotating components of the dryer than the rotating components, the non-rotating components represent a non-optimal positioning for the sensors. This problem is particular acute when the loads being dried are smaller loads (e.g. 2 to 5 pounds), very large loads (e.g. 12 pounds or greater) or loads containing clothes with large surfaces.

Therefore, clothes drying appliance systems featuring improved contact frequency between sensor and clothes are needed.

BRIEF DESCRIPTION OF THE INVENTION

Aspects and advantages of the invention will be set forth in part in the following description, or may be obvious from the description, or may be learned through practice of the invention.

One aspect of the present disclosure is directed to a clothes dryer. The clothes dryer includes a cabinet and a drum rotatably mounted within the cabinet. The drum defines a space for the receipt of clothes for drying. The clothes dryer includes a controller for controlling operation of the clothes dryer. The clothes dryer includes a plurality of sensors positioned within the drum. The plurality of sensors respectively output a plurality of output signals indicative of an amount of moisture contained within the clothes. The clothes dryer includes a near field communication (NFC) tag positioned on an exterior surface of the drum and wired to receive the output signals from the plurality of sensors. The clothes dryer includes a power supply electrically connected to the plurality of sensors so as to provide electrical power to the plurality of sensors. The clothes dryer includes an NFC reader positioned exterior to the drum. The NFC reader receives sensor data from the NFC tag and provides the sensor data to the controller, such that the controller can control operation of the clothes dryer based on the amount of moisture contained within the clothes. The plurality of sensors, the NFC tag, and the power supply are secured with respect to the drum so as rotate concurrently with the drum. The NFC reader is stationary and positioned adjacent to a rotational path of the NFC tag.

Another aspect of the present disclosure is directed to a method for drying clothes. The method includes obtaining, by a near field communication (NFC) tag, a combined output signal from a plurality of sensors positioned within a drum of a clothes dryer. The combined output signal is indicative of an amount of moisture remaining in items of clothing within the drum. The NFC tag is positioned on an exterior surface of the drum and rotates concurrently with the drum. The method includes transforming, by the NFC tag, the combined output signal into a digital signal. The method includes transmitting, by the NFC tag, the digital signal to an NFC reader. The NFC reader is stationary and positioned adjacent to a rotational path of the NFC tag. The method includes providing, by the NFC reader, the digital signal or an analog conversion of the digital signal to a controller. The method includes controlling, by the controller, operation of the clothes dryer based on the digital signal or the analog conversion of the digital signal.

Another aspect of the present disclosure is directed to a drying appliance. The drying appliance includes a plurality of sensors positioned inside a drum of the drying appliance. The plurality of sensors are wired together to provide a combined output signal indicative of one or more parameters of clothing inside the drum. The drying appliance includes a near field communication (NFC) tag mounted on an exterior surface of the drum. The NFC tag receives the combined output signal from the plurality of sensors. The drying appliance includes a battery or power supply that provides power to the plurality of sensors and the NFC tag. The power supply rotates concurrently with the drum. The drying appliance includes an NFC reader positioned on a stationary member of the drying appliance and receiving external utility power. The NFC reader receives sensor data from the NFC tag and provides the sensor data to a controller, such that the controller can control the drying appliance based on the one or more parameters of the clothing inside the drum.

These and other features, aspects and advantages of the present invention will be better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
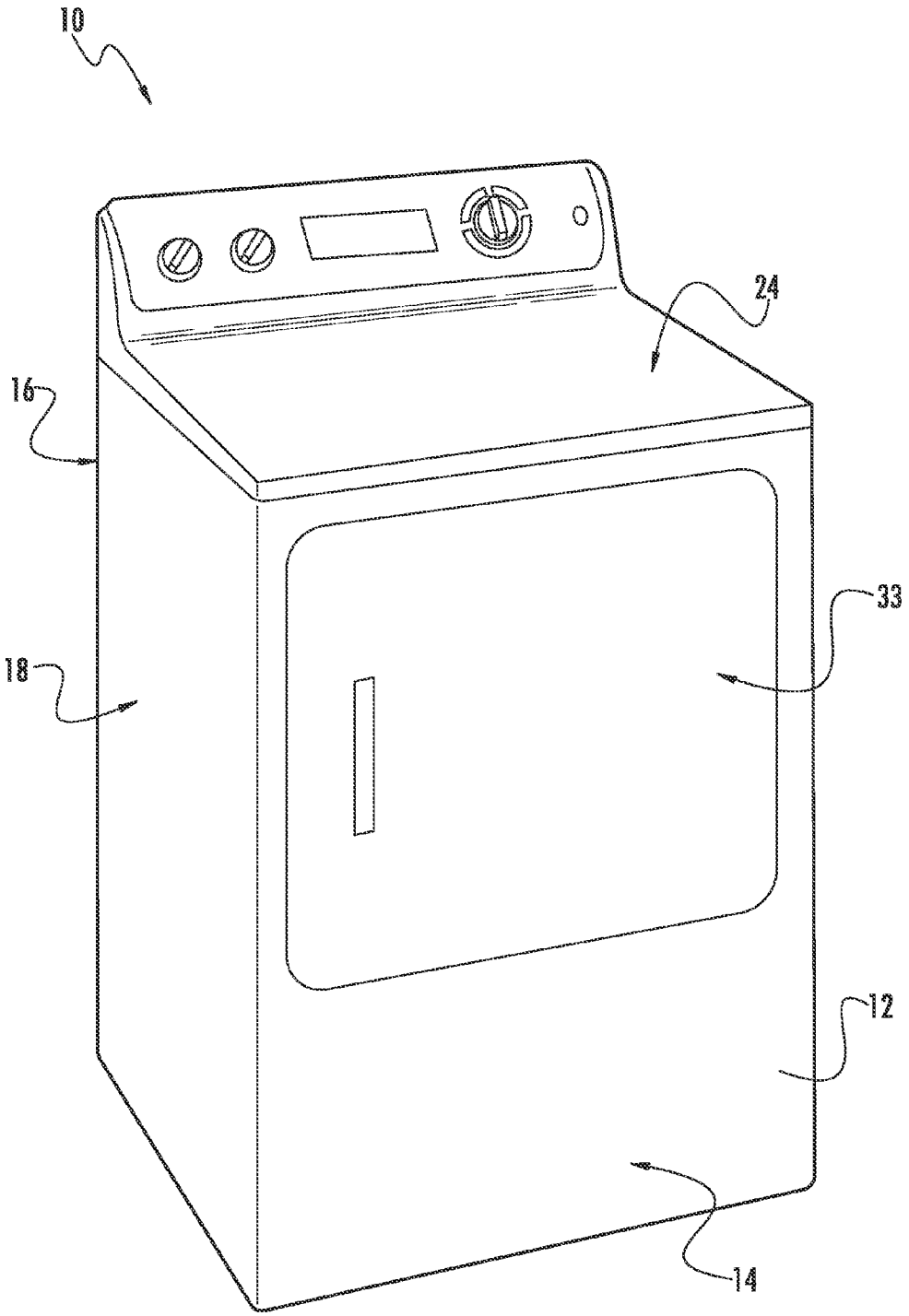
FIG. 1 provides a perspective view a dryer appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
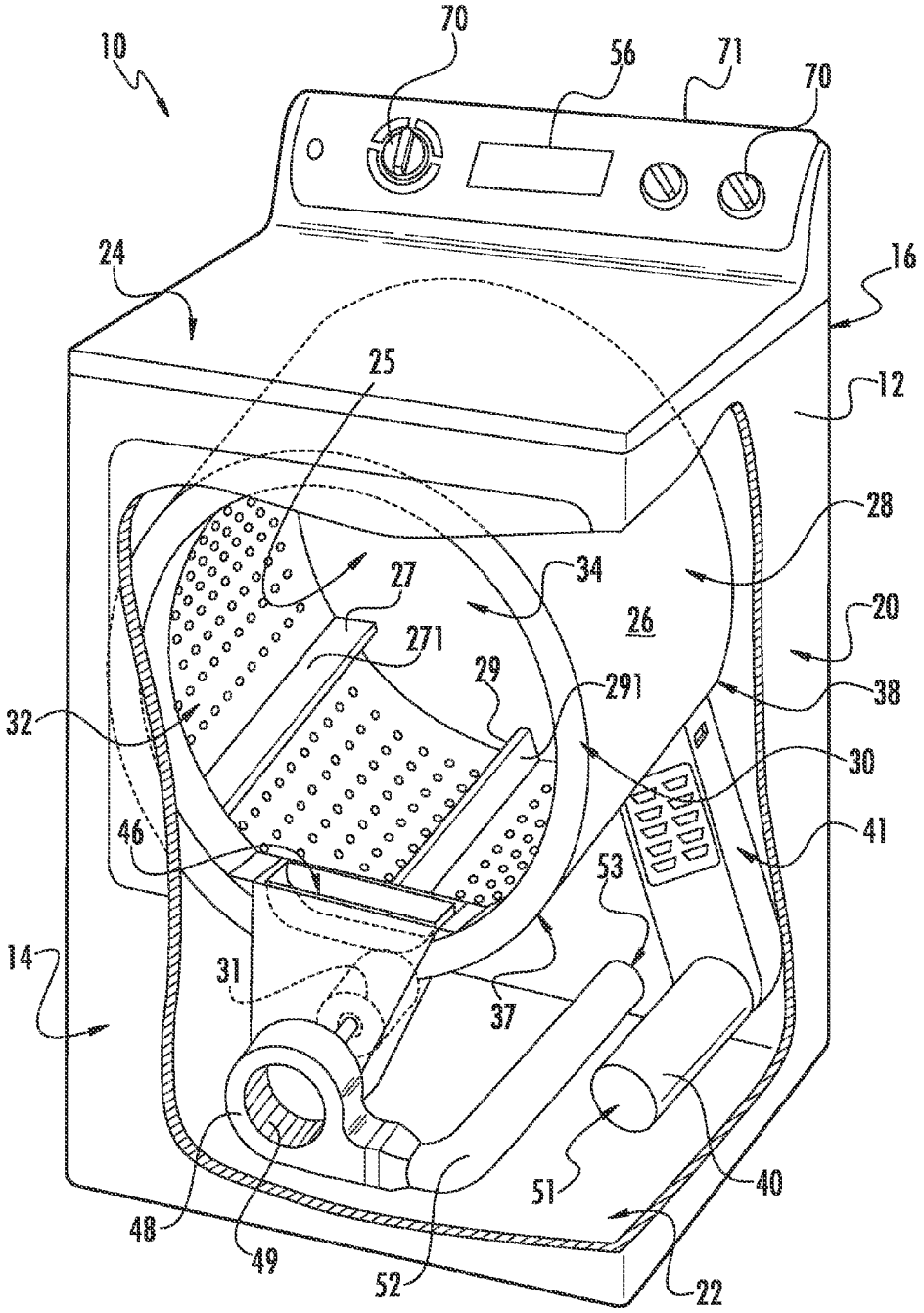
FIG. 2 provides another perspective view of the dryer appliance of FIG. 1 with a portion of a cabinet of the dryer appliance removed in order to show certain components of the dryer appliance.

FIG. 1 illustrates an example dryer appliance 10 according to an example embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 defines a chamber 25 for receipt of articles of clothing for drying. Drum 26 extends between a front portion 37 and a back portion 38.

As used herein, the term "clothing" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a laundry dryer (e.g. clothes dryer) and may include a mixture of different or similar articles of clothing of different or similar types and kinds of fabrics, textiles, garments and linens within a particular laundering process.

A motor 31 is configured for rotating drum 26 about the horizontal axis, e.g., via a pulley and a belt (not shown). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles (e.g. lifters 27 and 29) are provided within chamber 25 of drum 26 to lift articles therein and then allow such articles to tumble back to a bottom of drum 26 as drum 26 rotates.

In some embodiments, each lifter can have a lifting face and a non-lifting face. For example, in the instance in which the drum 26 rotates clockwise from the perspective of a viewer situated in front of the opening 32, lifter 27 will have a lifting face 271. Likewise, in the instance in which the drum 26 rotates clockwise from the perspective of a viewer situated in front of the opening 32, lifter 29 will have a non-lifting face 291. As will be discussed further below, in some embodiments of the present disclosure, one or more sensors may be positioned on the lifting face and/or non-lifting face of each lifter. Furthermore, lifters having shapes other than those shown in FIG. 2 may be used as well.

In some embodiments, the drum may reverse rotational directions during portions of various drying operations. In such embodiments, for example, the face of each lifter that performs lifting functionality for a majority of the operation time can be designated as the lifting face. As another example, the face of each lifter that performs lifting functionality during a critical period in which sensing of load moisture content is most relevant and scrutinized (e.g. the final period of drying) can be designated as the lifting face.

Drum 26 also includes a back or rear wall 34, e.g., at back portion 38 of drum 26. Rear wall 34 can be fixed or can be rotatable. A supply duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. For example, heating assembly 40 can include a heating element (not shown), such as a gas burner or an electrical resistance heating element, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air can accumulate moisture, e.g., from damp clothing disposed within chamber 25. In turn, air handler 48 draws moisture saturated air through a screen filter (not shown) which traps lint particles. Such moisture statured air then enters an exit duct 46 and is passed through air handler 48 to an exhaust duct 52. From exhaust duct 52, such moisture statured air passes out of dryer appliance 10 through a vent 53 defined by cabinet 12. After the clothing articles have been dried, they are removed from the drum 26 via opening 32. A door 33 provides for closing or accessing drum 26 through opening 32.

A cycle selector knob 70 is mounted on a cabinet backsplash 71 and is in communication with a processing device or controller 56. Signals generated in controller 56 operate motor 31 and heating assembly 40 in response to the position of selector knobs 70. Alternatively, a touch screen type interface may be provided. As used herein, "processing device" or "controller" may refer to one or more microprocessors, microcontroller, ASICS, or semiconductor devices and is not restricted necessarily to a single element. The controller can be programmed to operate drying machine 10 by executing instructions stored in memory. The controller may include, or be associated with, one or more memory elements such as for example, RAM, ROM, or electrically erasable, programmable read only memory (EEPROM).

Figure 3:
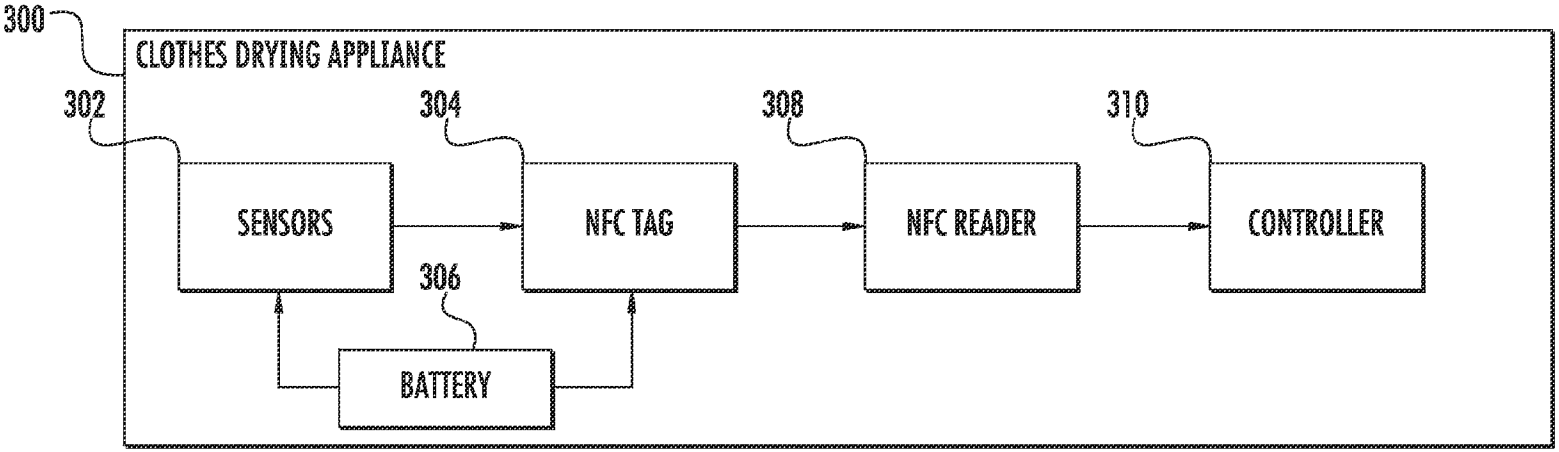
FIG. 3 depicts a block-diagram of an example clothes dryer control system according to an example embodiment of the present disclosure.

FIG. 3 depicts a block-diagram of an example clothes dryer control system 300 according to an example embodiment of the present disclosure. System 300 can include a plurality of sensors 302, a near field communication (NFC) tag 304, a battery 306, an NFC reader 308, and a controller 310.

The sensors 302 can be any suitable sensors for sensing one or more parameters of clothing inside a drum of the clothes dryer. For example, the sensors can be dryness sensors, relative humidity sensors, clothing temperature sensors, air temperature sensors, or other suitable sensors.

As an example, each sensor can be a conductivity sensor such as two conductive (e.g. metallic) rods in parallel, two conductive strips in parallel, or two different metal coatings on a lifter surface. Each conductivity sensor can be used to measure moisture content of the clothing or other parameters such as clothing surface temperature. In particular, in some embodiments, each sensor (e.g. each pair of conductive rods) can provide an output signal (e.g. voltage signal or current signal) corresponding to conductivity or resistance of clothes under drying indicating stage of drying versus time. The resistance/voltage decreases compared to a reference voltage when clothing with moisture simultaneously contacts any or all of the sensor pairs.

Furthermore, the amount by which the voltage decreases when clothing with moisture simultaneously contacts the two conductive portions can be proportional to the amount of moisture contained within the clothing. Therefore, in some embodiments, one of the conductive portions of the sensor may be held at a predetermined voltage (e.g. five volts). The voltage at such conductive portion will experience a decrease when clothing with moisture contacts both conductive portions. Such decrease will be proportional to the amount of moisture and will be reflected in the output signal.

In some embodiments, all of the sensors 302 can be wired together to provide a single, combined output signal. Thus, the combined output signal will reflect clothing parameters for the entirety of the drum. The combined output signal can be provided to the NFC tag 304. In further embodiments, sensors 302 may be organized into two or more groupings (e.g. based on sensor type or sensor position) that respectively provide two or more combined output signals to the NFC tag 304.

The NFC tag 304 can include circuitry for receiving the combined output signal, filtering, comparing, processing and transforming the combined output signal into a digital signal, and then transmitting the digital signal to the NFC reader using near field communication. Thus, in some embodiments, the NFC tag 304 can include an analog to digital converter or other circuitry for provided analog to digital functionality. In some embodiments, NFC tag 304 can also include a microprocessor or microcontroller configured to perform one-way or two-way near field communication with NFC reader 308.

In some embodiments, each communication from the NFC tag 304 to the reader 308 can include a minimum, maximum, and/or average value of the digital signal since the most recent transmission. In other embodiments, the entire digital signal can be transmitted or a number of samples of the digital signal (e.g. 10 samples) can be transmitted.

NFC tag 304 can be mounted on an exterior surface of the clothes dryer drum. Battery 306 can provide excitation energy to both sensors 302 and NFC tag 304. Battery 306 can be any suitable battery for providing energy. In some embodiments, the battery can include or be a component of an energy harvesting system that harvests energy to charge battery 306 from high temperatures present in the clothes dryer during drying operations. In some embodiments, the battery 306 can be a small, coin-type battery. In some embodiments, battery or power supply 306 can be part of NFC tag 304 or mounted separately on the drum surface or inside the lifters.

NFC reader 308 can include components and associated circuitry for receiving the digital signal from the NFC tag 304 and then providing the received digital signal to the controller 310. Thus, in some embodiments, NFC reader 308 can also include a microprocessor or microcontroller configured to perform one-way or two-way near field communication with NFC tag 304.

In some embodiments, NFC reader 308 can also contain a digital to analog converter as an internal component or separate device. Using such digital to analog converter, the NFC reader 308 can convert the digital signal to an analog output, process the analog output (e.g. by performing filtering, amplifying and scaling) and provide the processed analog output to the controller 310.

NFC reader 308 can be secured to the cabinet of the clothes dryer so that it is stationary. NFC reader 308 can be positioned adjacent to a rotational path of the NFC tag 304. Therefore, in some embodiments, data transfer between NFC tag 304 and NFC reader 308 can occur once per rotation when the tab 304 is located adjacent to the reader 308.

Figure 10:
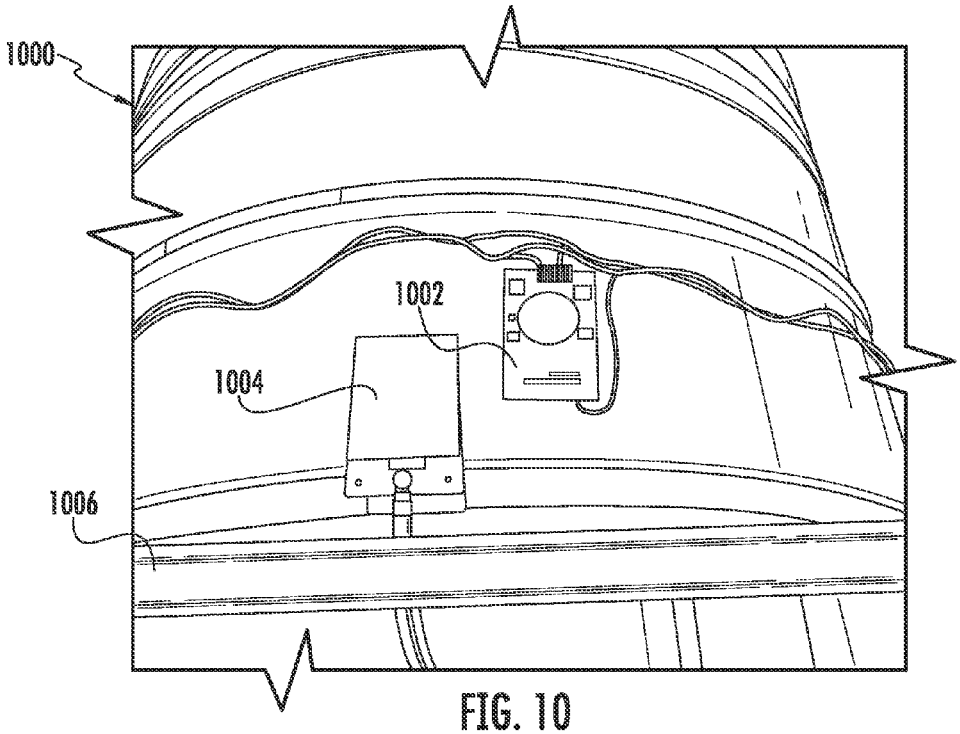
FIG. 10 depicts an exterior of a drum of an example clothes dryer according to an example embodiment of the present disclosure.

As an example, FIG. 10 depicts an exterior 1000 of a drum of an example clothes dryer according to an example embodiment of the present disclosure. Also shown in FIG. 10 is an NFC tag 1002 mounted to an exterior surface of the drum. The sensor wiring and battery are shown connected to the tag 1002. An NFC reader 1004 is mounted to a stationary member 1006 of the dryer apron.

Referring again to FIG. 3, after the NFC reader 308 receives the sensor data from NFC tag 304, reader 308 can provide the sensor data to the controller 310.

As noted above, controller 310 can be one or more processors, chips, microcontrollers, ASICs, or other circuitry for performing functionality. For example, controller 310 can perform instructions stored in an associated memory to perform the functionality.

Controller 310 can control the clothes drying appliance 300 based on the digital signal received from the NFC tag. As an example, controller 310 can determine a moving average of the digital signal, compare the moving average of the digital signal to a threshold value, and when the moving average of the digital signal exceeds the threshold value, de-energize a heater of the clothes drying appliance 300.

As another example, the controller 310 can compare the digital signal of the analog conversion of the digital signal to a threshold value and, when the digital signal or the analog conversion of the digital signal exceeds the threshold value, de-energize the heater of the clothes drying appliance 300.

Figure 4:
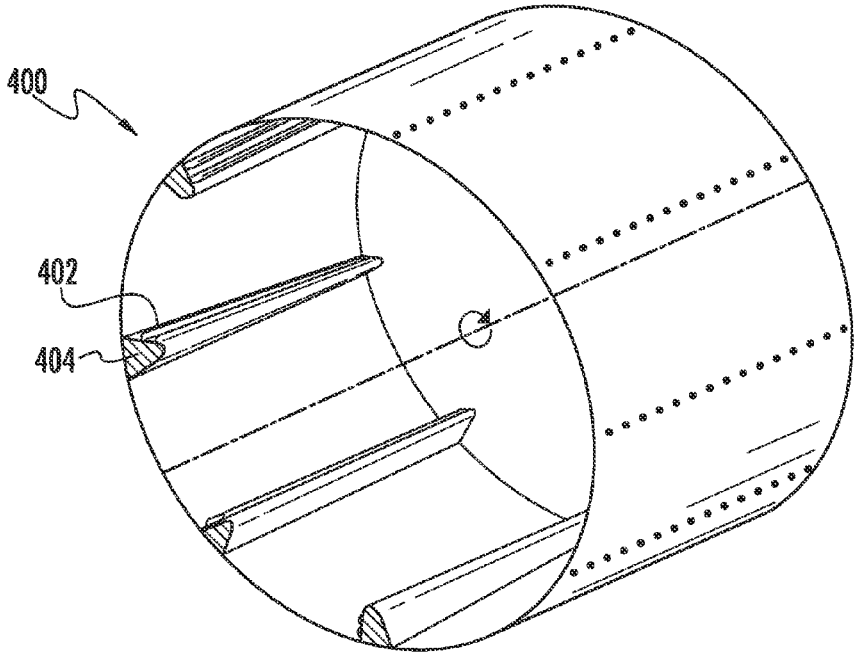
FIG. 4 provides a simplified depiction of a first example sensor placement according to an example embodiment of the present disclosure.

FIG. 4 provides a simplified depiction 400 of a first example sensor placement according to an example embodiment of the present disclosure. In particular, the first example sensor placement includes one of a plurality of sensors placed on the lifting face of each of a plurality of lifters included in a drum of a clothes dryer. As an example, sensor 402 (e.g. a pair of conductive rods) is positioned on a lifting face of lifter 404. In other embodiments, the plurality of sensors are placed on the non-lifting faces of the plurality of lifters instead of the lifting faces.

Figure 5:
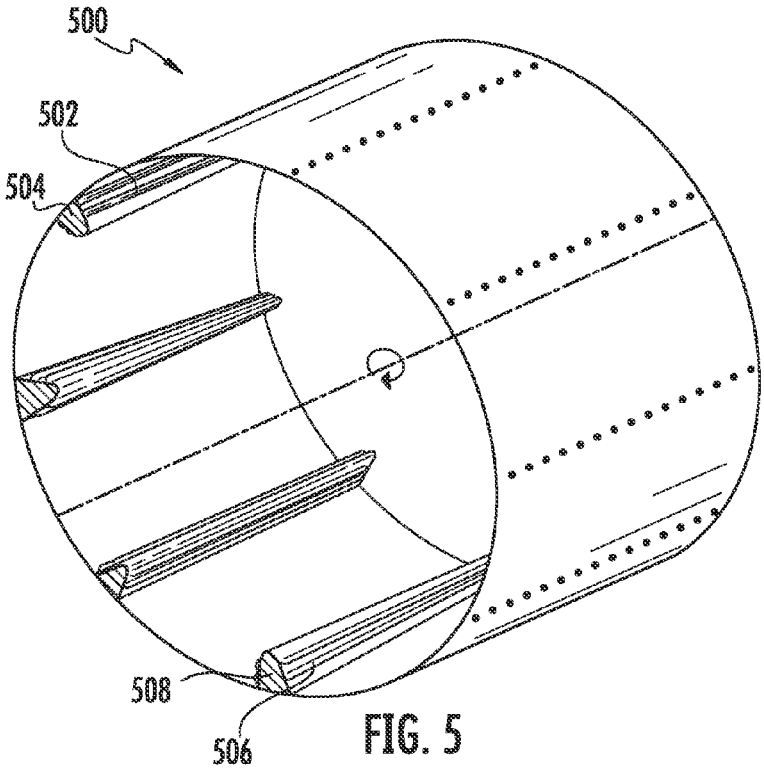
FIG. 5 provides a simplified depiction of a second example sensor placement according to an example embodiment of the present disclosure.

FIG. 5 provides a simplified depiction 500 of a second example sensor placement according to an example embodiment of the present disclosure. In particular, the second example sensor placement includes one of a plurality of sensors placed on each of the lifting face and the non-lifting face of each of a plurality of lifters included in a drum of a clothes dryer. As an example, sensor 502 (e.g. a pair of conductive rods) is positioned on a lifting face of lifter 504. Another sensor (e.g. another pair of conductive rods) is positioned on the non-lifting face of lifter 504.

As another example, sensor 506 (e.g. a pair of conductive rods) is positioned on the non-lifting face of lifter 508. Another sensor (e.g. another pair of conductive rods) is positioned on the lifting face of lifter 508.

In some embodiments having the second example sensor placement, all of the sensors (including, for example, sensors 502 and 506) can be wired together to provide a single combined output signal, regardless of whether the sensor is positioned on a lifting face or a non-lifting face.

In other embodiments having the second example sensor placement, all of the sensors that are positioned on lifting faces can be wired together to provide a first combined output signal. Likewise, all of the sensors that are positioned on non-lifting faces can be wired together to provide a second combined output signal. In such embodiments, data describing the first combined output signal can be transmitted from the NFC tag to the NFC reader separately from data describing the second combined output signal.

Figure 6:
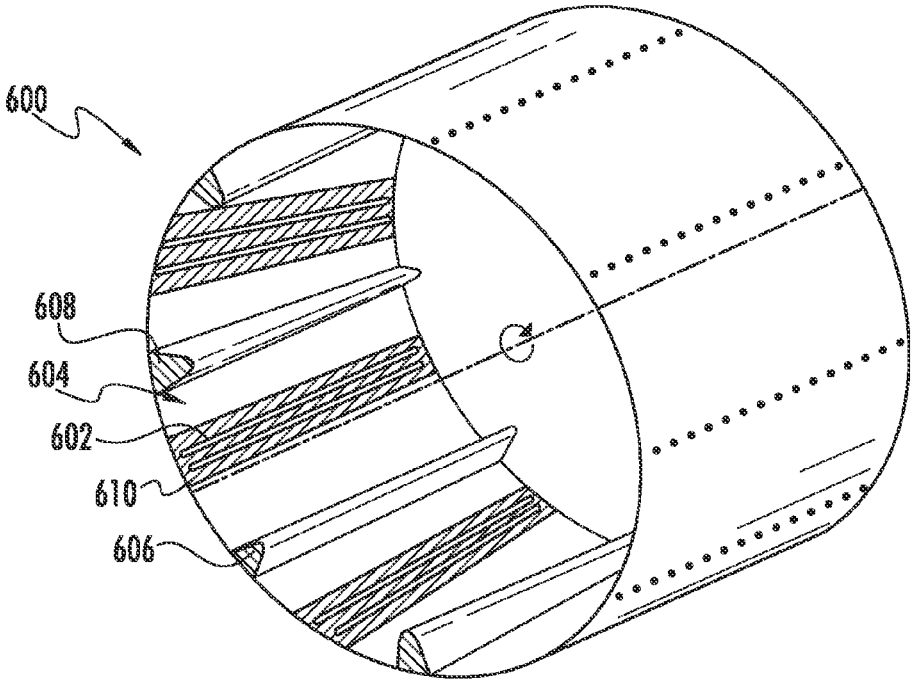
FIG. 6 provides a simplified depiction of a third example sensor placement according to an example embodiment of the present disclosure.

FIG. 6 provides a simplified depiction 600 of a third example sensor placement according to an example embodiment of the present disclosure. In particular, the third example sensor placement includes one of a plurality of sensors placed within each of a plurality of basins formed between respective adjacent pairs of lifters. As an example, sensor 602 (e.g. a pair of conductive rods) is positioned in a basin 604 formed between lifters 606 and 608.

Furthermore, in some embodiments having the third example sensor placement, an insulative (e.g. non-conductive) material can be placed between each sensor and the interior drum surface so that the conductive components of each sensor remain electrically isolated. As an example, an insulative material 610 is placed between the sensor 602 and the interior surface of the drum.

Figure 7:
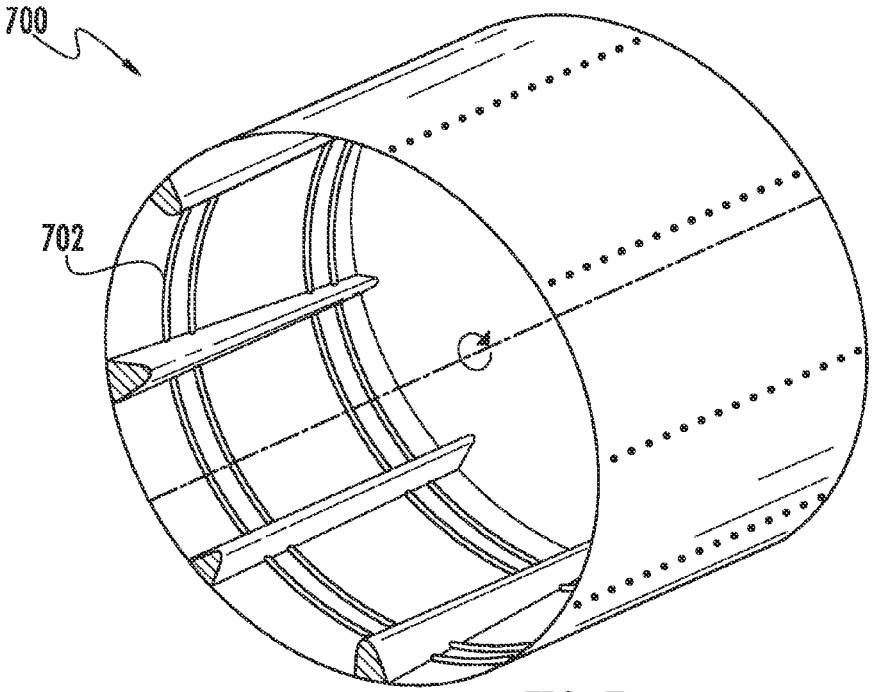
FIG. 7 provides a simplified depiction of a fourth example sensor placement according to an example embodiment of the present disclosure.

FIG. 7 provides a simplified depiction 700 of a fourth example sensor placement according to an example embodiment of the present disclosure. In particular, the fourth example sensor placement includes a plurality of circumferentially-oriented sensors positioned along an interior surface of the drum at respective longitudinal axis positions. For example, sensor 702 is a circumferentially-oriented sensor (e.g. two circumferentially-oriented conductive rods positioned adjacent to one another). The sensors can be circular (e.g. extend along the full circumference of the interior of the drum), semi-circular, three-fourths circular, or other suitable lengths, including non-identical lengths.

Figure 8:
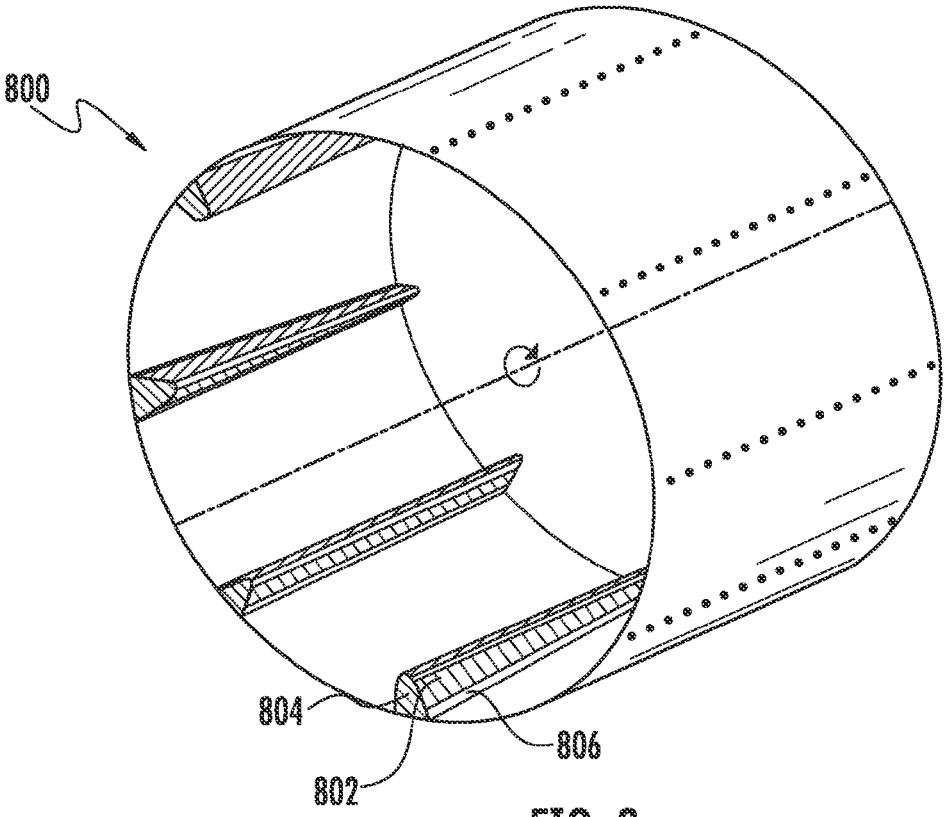
FIG. 8 provides a simplified depiction of a fifth example sensor placement according to an example embodiment of the present disclosure.

FIG. 8 provides a simplified depiction 800 of a fifth example sensor placement according to an example embodiment of the present disclosure. In particular, the fifth example sensor placement includes a conductive (e.g. metallic) coating or cladding covering two different portions of the surface of each lifter.

As an example, a first conductive coating 802 covers a portion of the non-lifting face of lifter 804. A second conductive coating (not shown) can cover a portion of the lifting face of lifter 804. The two conductive portions can operate to provide sensing similar to the two conductive rods discussed above. The two conductive portions may or may not be composed of different materials, but should be electrically isolated from one another.

Furthermore, a portion of the lifter that interfaces with the interior surface of the drum can remain uncovered so that each conductive portion remains electrically isolated from the interior surface of the drum. For example, portion 806 of lifter 804 is uncovered.

Figure 9:
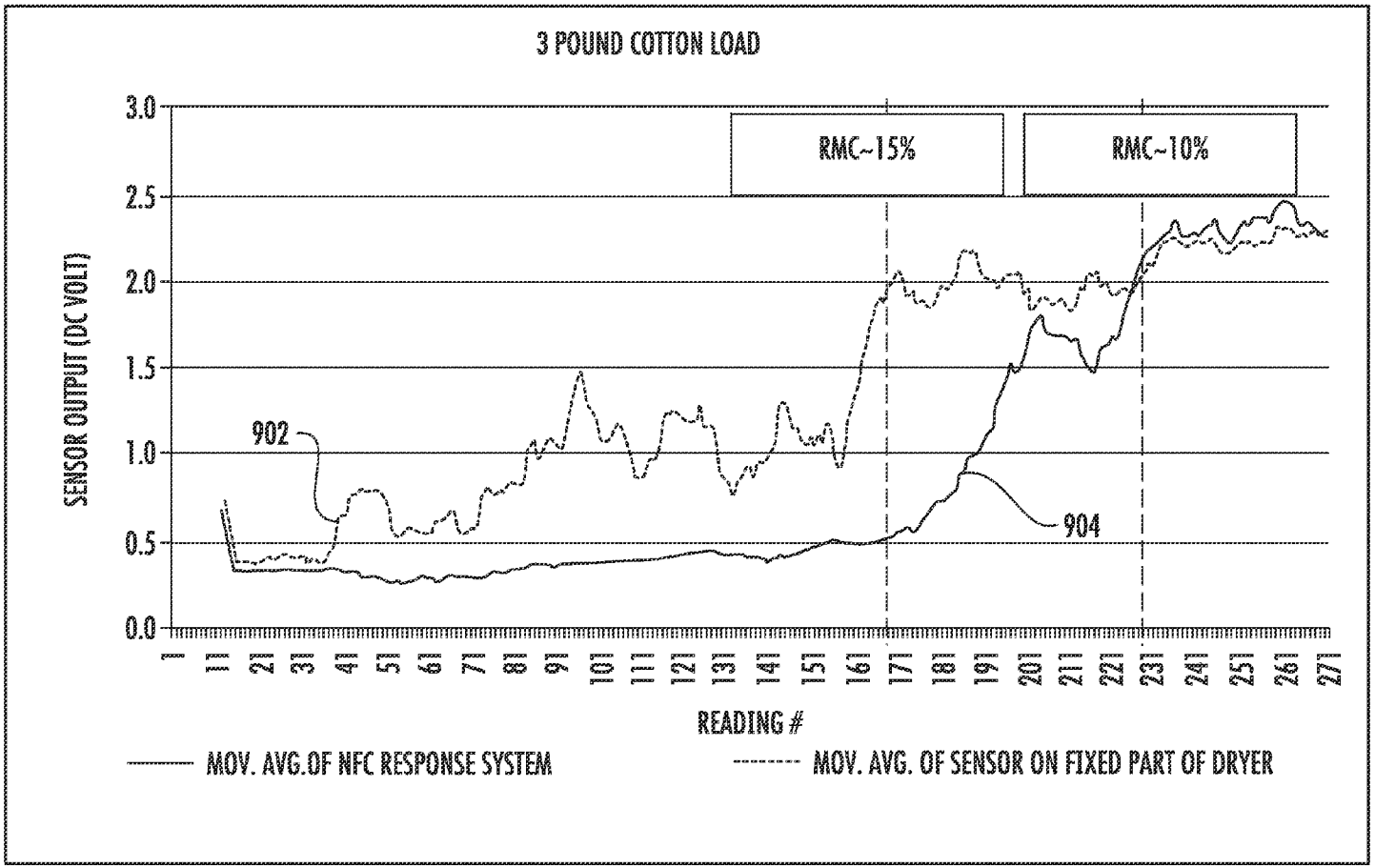
FIG. 9 depicts sensor data according to an example embodiment of the present disclosure.

FIG. 9 depicts sensor data according to an example embodiment of the present disclosure. In particular, plot 902 represents a moving average of a sensor output signal for sensors placed on one or more non-rotating parts. Plot 904 represents a moving average of a sensor output signal for sensors placed according to the NFC response system of the present disclosure.

As can be seen from a comparison of plot 902 to plot 904, the moving average of the output signal for sensors placed on one or more non-rotating components increases to larger voltages while the residual moisture content of the clothing is still about fifteen percent. By contrast, the moving average of the output signal for sensors placed according to the NFC response system of the present disclosure does not increase to the larger voltages until the residual moisture content of the clothing reaches about ten percent. Thus, the improved sensor placements of the present disclosure provide improved sensor accuracy for clothing moisture content.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A clothes dryer, comprising:
a cabinet;
a drum rotatably mounted within the cabinet, the drum defining a space for the receipt of clothes for drying;
a controller for controlling operation of the clothes dryer;
a plurality of sensors positioned within the drum, wherein the plurality of sensors respectively output a plurality of output signals indicative of an amount of moisture contained within the clothes;
a near field communication (NFC) tag positioned on an exterior surface of the drum and wired to receive the output signals from the plurality of sensors;
a power supply electrically connected to the plurality of sensors so as to provide electrical power to the plurality of sensors; and
an NFC reader positioned exterior to the drum, wherein the NFC reader receives sensor data from the NFC tag and provides the sensor data to the controller, such that the controller can control operation of the clothes dryer based on the amount of moisture contained within the clothes;
wherein the plurality of sensors, the NFC tag, and the power supply are secured with respect to the drum so as rotate concurrently with the drum; and
wherein the NFC reader is stationary and positioned adjacent to a rotational path of the NFC tag.

2. The clothes dryer of claim 1, wherein:
each of the plurality of sensors comprises at least two separate conductive portions;
the output signal for each sensor comprises an electrical signal describing an electrical characteristic at at least one of the conductive portions versus time;
the electrical signal decreases when clothing with moisture contacts any or all of the two conductive portions; and
the amount by which the electrical signal decreases when clothing with moisture contacts any or all of the two conductive portions is proportional to the amount of moisture contained within the clothing.

3. The clothes dryer of claim 2, wherein the plurality of sensors are wired together to provide a combined output signal to the NFC tag.

4. The clothes dryer of claim 3, wherein the NFC tag transforms the combined output signal into a digital signal, the sensor data comprising the digital signal.

5. The clothes dryer of claim 4, wherein the controller controls operation of the clothes dryer based the digital signal or an analog conversion of the digital signal.

6. The clothes dryer of claim 1, further comprising:
a plurality of lifters protruding at different positions along an interior surface of the drum;
wherein each of the plurality of lifters has a lifting face; and
wherein the plurality of sensors are respectively positioned at the plurality of lifting faces of the plurality of lifters.

7. The clothes dryer of claim 1, further comprising:
a plurality of lifters protruding at different positions along an interior surface of the drum;
wherein each of the plurality of lifters has a lifting face and a non-lifting face;
wherein one of the plurality of sensors is positioned at the lifting face of each lifter; and
wherein one of the plurality of sensors is positioned at the non-lifting face of each lifter.

8. The clothes dryer of claim 7, wherein:
the sensors positioned at the lifting faces of the plurality of lifters are wired together to provide a first combined output signal to the NFC tag;
the sensors positioned at the non-lifting faces of the plurality of lifters are wired together to provide a second combined output signal to the NFC tag; and
the NFC tag transmits both the first and second combined output signals to the NFC reader separately.

9. The clothes dryer of claim 1, further comprising:
a plurality of lifters protruding at different positions along an interior surface of the drum;
wherein a plurality of basins along the interior surface of the drum are respectively defined between each pair of adjacent lifters; and
wherein the plurality of sensors are respectively positioned within the plurality of basins.

10. The clothes dryer of claim 9, further comprising an insulative material placed between each of the plurality of sensors and the interior surface of the drum.

11. The clothes dryer of claim 1, wherein:
the drum is cylinder-shaped and has a longitudinal axis;
the plurality of sensors comprise circumferentially-oriented sensors positioned along an interior surface of the drum at respective longitudinal axis positions.

12. The clothes dryer of claim 11, wherein each of the plurality of sensors is one of circular, semi-circular, or three-fourths circular in shape.

13. The clothes dryer of claim 1, further comprising:
a plurality of lifters protruding at different positions along an interior surface of the drum;
wherein a surface of each of the plurality of lifters is coated with a conductive material except for where the lifter contacts the interior surface of the drum; and
wherein the plurality of sensors comprise the plurality of conductive surfaces of the plurality of lifters.

14. A method for drying clothes, the method comprising:
obtaining, by a near field communication (NFC) tag, a combined output signal from a plurality of sensors positioned within a drum of a clothes dryer, wherein the combined output signal is indicative of an amount of moisture remaining in items of clothing within the drum, and wherein the NFC tag is positioned on an exterior surface of the drum and rotates concurrently with the drum;
transforming, by the NFC tag, the combined output signal into a digital signal;
transmitting, by the NFC tag, the digital signal to an NFC reader, wherein the NFC reader is stationary and positioned adjacent to a rotational path of the NFC tag;
providing, by the NFC reader, the digital signal or an analog conversion of the digital signal to a controller; and
controlling, by the controller, operation of the clothes dryer based on the digital signal or the analog conversion of the digital signal.

15. The method of claim 14, further comprising converting the digital signal into an analog signal using a digital to analog converter, wherein the controller controls operation of the clothes dryer based on the analog signal.

16. The method of claim 14, wherein controlling, by the controller, operation of the clothes dryer based on the digital signal or the analog conversion of the digital signal comprises:

comparing, by the controller, the digital signal or the analog conversion of the digital signal to a threshold value; and when the digital signal or the analog conversion of the digital signal exceeds the threshold value, de-energizing, by the controller, a heater of the clothes dryer.

17. A drying appliance, the drying appliance comprising:

a plurality of sensors positioned inside a drum of the drying appliance, the plurality of sensors wired together to provide a combined output signal indicative of one or more parameters of clothing inside the drum;

a near field communication (NFC) tag mounted on an exterior surface of the drum, wherein the NFC tag receives the combined output signal from the plurality of sensors;

a power supply that provides power to the plurality of sensors and the NFC tag, the power supply rotating concurrently with the drum;

an NFC reader positioned on a stationary member of the drying appliance and receiving external utility power, wherein the NFC reader receives sensor data from the NFC tag and provides the sensor data to a controller, such that the controller can control the drying appliance based on the one or more parameters of the clothing inside the drum.

18. The drying appliance of claim 17, further comprising:

a plurality of lifters protruding from an interior surface of the drum at a plurality of different positions;

wherein the plurality of sensors are mounted to one or more of a lifting face of each of the plurality of lifters and a non-lifting face of each of the plurality of lifters.

19. The drying appliance of claim 17, further comprising:

a plurality of lifters protruding from an interior surface of the drum at a plurality of different positions;

wherein a plurality of basins along the interior surface of the drum are respectively defined between each pair of adjacent lifters; and wherein the plurality of sensors are respectively positioned within the plurality of basins.

20. The drying appliance of claim 17, wherein:

the drum is cylinder-shaped and has a longitudinal axis;

the plurality of sensors comprise circumferentially-oriented sensors positioned along an interior surface of the drum at respective longitudinal axis positions.

* * * * *